US011407554B2

(12) United States Patent
Gray

(10) Patent No.: US 11,407,554 B2
(45) Date of Patent: Aug. 9, 2022

(54) RECLOSABLE FOLDING BOX WITH A TAMPER-EVIDENT CLOSURE, AND FOLDING BOX BLANK FOR PRODUCING SAME

(71) Applicant: Novartis AG, Basel (CH)

(72) Inventor: Ian Andrew Gray, Basel (CH)

(73) Assignee: Novartis AG, Basel (CH)

( * ) Notice: Subject to any disclaimer, the term of this patent is extended or adjusted under 35 U.S.C. 154(b) by 0 days.

(21) Appl. No.: 16/091,829

(22) PCT Filed: Apr. 6, 2017

(86) PCT No.: PCT/EP2017/058205
§ 371 (c)(1),
(2) Date: Oct. 5, 2018

(87) PCT Pub. No.: WO2017/174704
PCT Pub. Date: Oct. 12, 2017

(65) Prior Publication Data

US 2019/0127112 A1 May 2, 2019

(30) Foreign Application Priority Data

Apr. 7, 2016 (EP) ..... 16164142

(51) Int. Cl.
*B65D 5/54* (2006.01)

(52) U.S. Cl.
CPC ..... *B65D 5/5405* (2013.01); *B65D 5/541* (2013.01); *B65D 2401/15* (2020.05); *B65D 2401/55* (2020.05)

(58) Field of Classification Search
CPC ..... B65D 2101/0015; B65D 2401/00; B65D 2401/055; B65D 2401/15; B65D 5/5435
(Continued)

(56) References Cited

U.S. PATENT DOCUMENTS 3,361,332 A * 1/1968 Mason ..... B65D 5/541 229/240
3,971,506 A * 7/1976 Roenna ..... B65D 5/701 229/234
(Continued)

FOREIGN PATENT DOCUMENTS

CN 203780923 U 8/2014
DE 4423468 A1 1/1996
(Continued)

OTHER PUBLICATIONS

International Search Report and Written Opinion dated May 10, 2017 in PCT Application No. PCT/EP2017/058205, English translation of International Search Report only (15 pages).
(Continued)

*Primary Examiner* — Nathan J Newhouse
*Assistant Examiner* — Phillip D Schmidt
(74) *Attorney, Agent, or Firm* — Viering Jentschura & Partner mbB

(57) ABSTRACT

In a reclosable folding box (41, 42, 43) having a safety and tamper-evident closure (84), the side wall surfaces (2 to 6, 64, 65) of which are formed by a one-piece blank (1, 1*a*, 1*b*) and glued together in such a way that the folding box (41, 42, 43) cannot be opened without destroying a glued joint and/or at least one disconnectable tear line area (16, 17, 16*a*, 16*b*, 17*a*, 17*b*), a solution for a reclosable medical packaging having a safety and tamper-evident closure is to be created, which provides an improved graspability and visual recognizability of a pull tab forming at least the substantial part of the safety and tamper-evident closure. This is achieved by the fact that the pull tab (18) reaches a folding box edge (39, 52) with an edge-side boundary line (85) and is printed on a folding box outer side with a first linear pattern (20), in particular a guilloche pattern, extending at least in part with at least one pattern line beyond the tear line area(s) (16, 17,
(Continued)

Figure 1:
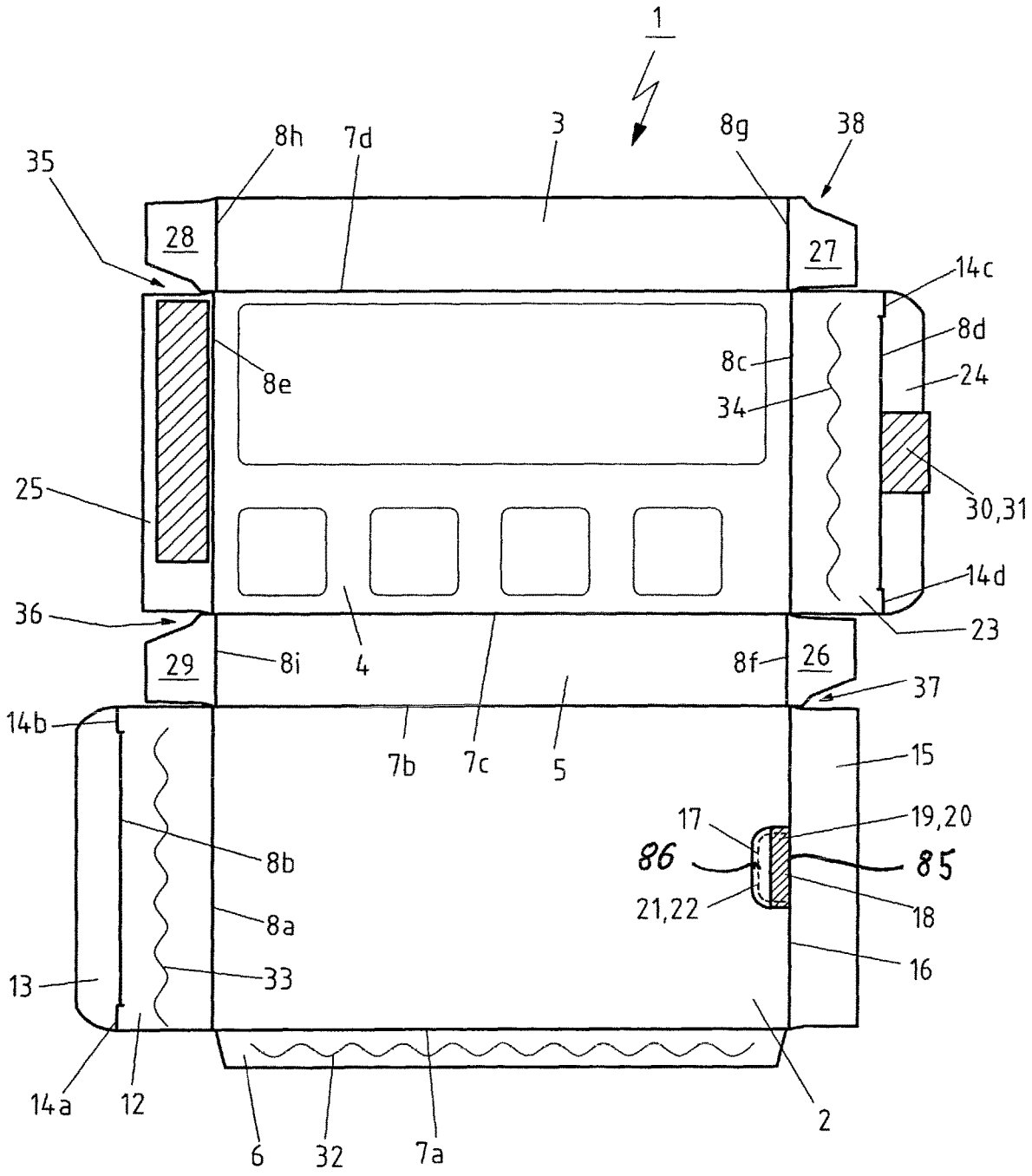

16*a,* 16*b,* 17*a,* 17*b*), which first linear pattern (20) adjoins an area (21, 22) visible from the folding box outer side and printed in contrast color with respect to the first linear pattern (20), which is formed in a way to encompass, at least to include the pull tab (18), in the area of an edge-side limiting edge (86) of the pull tab (18) on the outer side on a first side wall surface (2), or which is formed in the area of the boundary line (85) at least on a surface area of a second side wall surface (3) facing the folding box outer side and covered by the pull tab (18), as well on the outer side of a third side wall surface (4) hinged to the second side wall surface (3) and adjoining the pull tab (18), in a way to graduate into the same.

6 Claims, 5 Drawing Sheets

(58) Field of Classification Search
USPC ..... 229/102, 240–244, 233–234
See application file for complete search history.

(56) References Cited

U.S. PATENT DOCUMENTS 4,141,485 A * 2/1979 Lambert ..... B65D 5/723 229/220
4,260,061 A * 4/1981 Jacobs ..... B65D 75/5833 383/203
4,613,046 A * 9/1986 Kuchenbecker ..... B65D 5/541 229/208
4,746,061 A * 5/1988 Arvanigian ..... B65D 5/0236 206/807
4,936,464 A * 6/1990 Kim ..... C09J 7/20 229/123.1
8,944,312 B2 * 2/2015 Won ..... B65D 5/0254 229/102
9,505,520 B2 * 11/2016 Baker ..... B65D 5/723
2005/0145683 A1 * 7/2005 Alagna ..... B65D 5/541 229/102
2006/0049239 A1 * 3/2006 Shaw ..... B65D 5/5425 229/102
2009/0014350 A1 * 1/2009 Gaumont ..... A61J 1/035 206/528
2011/0139865 A1 * 6/2011 Raeth ..... B65D 5/541 229/244
2016/0214758 A1 * 7/2016 Yamamura ..... B65D 5/4266

FOREIGN PATENT DOCUMENTS

DE 102004005333 A1 1/2005
EP 1650131 A1 4/2006
JP 2002-542119 A 12/2002
JP 2012041082 A * 3/2012 ..... B65D 5/5455
WO WO-9719863 A1 * 6/1997 ..... B65D 27/34

OTHER PUBLICATIONS

Kumbhar, Manoj Shivaji, et al. "Tamper Evident Pharmaceutical Packaging—Needs and Advances" International Journal of Pharmaceutical Sciences Review and Research, vol. 13, Issue 2, pp. 141-153, Mar.-Apr. 2012. Retrieved from URL: http://globalresearchonline.net/journalcontents/v13-2/030.pdf.
Murphy, Mary. "Packaging and Counterfeit Pharmaceuticals" PharmTech.com, Pharmaceutical Technology Europe, vol. 15, Issue 9, Sep. 1, 2003. Retrieved from URL: http://www.pharmtech.com/packaging-and-counterfeit-pharmaceuticals on Oct. 2, 2018.
Chinese Office Action dated Feb. 28, 2020 in Chinese Patent Application No. 201780034871.7, and English translation thereof (17 pages).

* cited by examiner

RECLOSABLE FOLDING BOX WITH A TAMPER-EVIDENT CLOSURE, AND FOLDING BOX BLANK FOR PRODUCING SAME

RELATED APPLICATIONS

This application is a United States National Phase under 35 U.S.C. § 371 of International Application No. PCT/EP2017/058205, filed on Apr. 6, 2017, which claims priority to European Patent Application No. 16164142.8, filed Apr. 7, 2016, both of which are hereby incorporated by reference in their entirety for all purposes.

The invention is directed to a reclosable folding box having a safety and tamper-evident closure comprising a pull tab, the side wall surfaces of which are formed by a one-piece blank and are glued together in such a way that the folding box cannot be opened without destroying a glued joint and/or at least one disconnectable tear line area.

Equally, the invention is directed to a folding box blank for producing a reclosable folding box having a safety and tamper-evident closure comprising a pull tab, and having side wall surfaces which are formed by a one-piece blank in a way to be glued, especially together, in such a way, that the folding box formed thereby cannot be opened without destroying a glued joint and/or at least one disconnectable tear line area.

Due to statutory regulations, the pharmaceutical industry is obliged to provide for particular medical products intended for human application particular safety features as part of the outer packaging of the medical product. It is part of these safety features to provide measures which enable a user to recognize whether the packaging has already been opened, i.e. whether somebody has already tampered with the outer packaging.

In addition, medical products are often provided in such a way that an outer packaging contains medical products, such as capsules, pills or the like, which for their part are once more packed in a blister package. When being used, single medical products are taken from the blister package, whereas others remain in the blister package. These blister packages are then pushed back or put back into the outer packaging, so that it is in addition frequently desirable to have an outer packaging which is also formed to be reclosable. In this case, "reclosable" means that the packaging may be closed to such an extent that it remains in the closed position independently and can be easily re-opened by its user.

In order to be able to determine whether a packaging has already been opened, various folding boxes having a safety and tamper-evident closure are known in practice, wherein cuboid folding boxes are closed all around by an appropriate adhesion of their different side surfaces and tabs, and can be opened only by destroying glued joints, except for the safety and tamper-evident closure formed on one side. In this case, the safety and tamper-evident closure comprises a non-glued pull tab, by means of which said side surface of longitudinally formed tear line areas can be removed from the plane of the respective folding box side, thereby opening the packaging. A generic packaging of this type is known from DE 10 2004 005 333 A1 and from DE 44 23 468 A1.

These known types of packaging have the drawback that the only visual indicator for the user showing whether the packaging in question has already been opened is that the user has to check whether the perforation lines, which are to be destroyed during the opening process, actually have been destroyed. In addition, the respective pull tab ends in the surface of a side wall surface of the folding box resting against it thereunder. The boundary line of the pull tab to be grasped for tearing the packaging open is therefore difficult to grasp for a user. Moreover, these types of packaging are not provided with a visualizing indicator showing the pull tab area to be grasped for opening.

The invention is therefore based on the object to provide a solution for a reclosable medical packaging having a safety and tamper-evident closure, which provides an improved graspability and visual recognizability of a pull tab forming at least the substantial part of the safety and tamper-evident closure.

In a reclosable folding box of the type initially described in more detail, this problem is, according to the invention, solved by the pull tab reaching a folding box edge with an edge-side boundary line and being printed on the folding box outer side with a first linear pattern, in particular a guilloche pattern, extending at least in part with at least one pattern line beyond the tear line area(s), which first linear pattern abuts against an area which is visible from the folding box outer side and which is printed to be in color contrast with respect to the first linear pattern, which is formed in a way to encompass, at least to include the pull tab, in the area of an edge-side limiting edge of the pull tab on the outer side on a first side wall surface, or which is formed in the area of the boundary line at least on a surface area of a second side wall surface facing the folding box outer side and covered by the pull tab, as well on the outer side of a third side wall surface hinged to the second side wall surface and adjoining the pull tab, in a way to graduate into the same.

In addition, as to a folding box blank of the type initially described in more detail, the above-mentioned problem is solved by the pull tab being printed on its folding box outer side upper side with a first linear pattern, especially a guilloche pattern, extending with a pattern line at least in part beyond the tear line area(s), which first linear pattern is formed on a first side wall surface and, when the folding box is erected from the folding box blank, abuts against an area visible from the folding box outer side and printed in contrast color with respect to the first linear pattern, which is formed in a way to encompass, at least to include the pull tab, in the area of an edge-side limiting edge of the pull tab on the outer side on the first side wall surface, or which first linear pattern is formed on the first side wall surface foldable when the folding box is erected from the folding box blank to a second side wall surface in such a way that it abuts against an area visible from the folding box outer side and printed in contrast color to the first linear pattern, when the folding box is erected from the folding box blank, which is formed at least on a surface area of the second side wall surface facing the folding box outer side, as well as on the outer side of a third side wall surface hinged to the second side wall surface in a way to graduate into the same, wherein, when the folding box is erected and the first side wall surface is folded onto the second side wall surface, the area printed in contrast color is arranged in the area of a boundary line of the pull tab reaching a folding box edge and is covered at least for the most part by the pull tab in the surface area of the second side wall surface, and the pull tab abuts against the third side wall surface.

Advantageous embodiments and practical developments of the subject matters of the invention form the subject matter of the respective dependent claims.

The folding box proposed according to the invention constitutes a safety packaging insofar as it can be opened only by destroying glued joints or tear lines, such as carvings or carving lines or perforation lines, so that a destruction of the packaging that has happened is immediately recognizable from the outside. In this respect, especially the area of the pull tab is provided in such a way that a possible destruction or manipulation that has taken place can be recognized and noticed visually by the pull tab being printed with a linear pattern which extends with at least one pattern line beyond the tear line area delimiting the pull tab into the adjoining side wall surface area of a folding box side wall. Graspability of the pull tab is improved by the fact that the pull tab reaches the adjoining folding box edge area with an edge-side boundary line, so that this area can easily be grasped or pushed-in with the fingers of one hand, whereby the pull tab can be moved into its opening position. The recognizability of this manipulation area of the pull tab is supported by the fact that another color print in a contrast color contrasting with the linear pattern is formed in this area.

In order to recognize a packaging that has already been opened, it is in addition advantageous if the outer side surface of a folding box side wall surface disposed under the pull tab is also marked with colors. The invention therefore provides an embodiment, according to which a second linear pattern, especially a second guilloche pattern is formed on the surface of the second side wall surface facing the folding box outer side or an insertion tab hinged to a third side wall surface in an area covered by the abutting pull tab, which differs from the first linear pattern in color and/or in terms of contrast.

In order to further improve the graspability of the pull tab, the folding box according to the invention is formed with a grasp or gripping recess (thumb cavity) recessed in a trough-like manner in the edge area of the folding box adjoining the pull tab. According to an embodiment of the invention, this is achieved by the articulation of the second and third side wall surfaces being formed as a side edge of the folding line forming the erected folding box, which in the area printed in contrast colors splits into two folding line courses, thereby forming an enclosed pointed oval, and re-unites to the one folding line, and thereby forms a trough-like side edge area in the area of the pull tab.

In order to make the integrity of a tear line to be torn upon opening recognizable more easily, the area printed in contrasting colors extends at least in part over the tear line area(s) according to another advantageous embodiment of the invention.

In addition, the invention is also characterized by the tear line area being formed as a linear carving or perforation line. The tear lines to be torn when the folding box is opened, especially when the pull tab is broken or ripped open, may in a particularly advantageous manner be formed as a carving or a linear carving or a perforation line.

Moreover, according to an advantageous embodiment of the invention, the folding box is formed by a one-piece folding box blank having at least four side wall surfaces respectively forming two opposite narrow and broad side walls of the folding box, and at least two side wall surfaces forming opposed head and bottom side walls.

In addition, according to another advantageous embodiment of the invention, the safety and tamper-evident closure is formed by the un-glued pull tab which, alongside of the at least one or more delimiting tear line area(s), is detachably integrated in the external first side wall surface of the folding box.

Finally, according to another advantageous embodiment, the folding box according to the invention is characterized by the fact that the reclosability is enabled by means of forming areas incised on head-side or bottom-side tabs of the folding box blank in such a way that these forming areas form insertion areas for co-operating closure areas of an associated head-side or bottom-side insertion tab, or is enabled by an insertion slit cooperating with an insertion tongue hinged on the pull tab.

The advantages previously described with respect to the reclosable folding box apply analogously to the corresponding feature combinations of the dependent claims with respect to the folding box blank according to the invention. According to an embodiment, this folding box blank is characterized in that a second linear pattern, in particular a second guilloche pattern, which differs from the first linear pattern in color and/or in terms of contrast, is formed on the surface of the second side wall surface facing the folding box outer side or an insertion tab hinged to a third side wall surface in an area covered by the abutting pull tab when the folding box is erected.

In addition, it is advantageous according to an embodiment if the articulation of the second and third side wall surfaces is formed as a side edge of the folding line forming the erected folding box, which in the area printed in contrast colors splits into two folding line courses, thereby forming an enclosed pointed oval, and re-unites to the one folding line, and thereby forms a trough-like side edge area in the area of the pull tab, which is also provided for by the invention.

It is, in addition, advantageous if the area printed in contrasting colors extends at least in part over the tear line area(s).

The pull tab may be formed to be detachable in a particularly good and easy way by the tear line area being formed as a linear carving or as a perforation line, which is also provided for by the invention.

The solution according to the invention is, in addition, advantageous in a folding box blank which is formed in one piece having at least four side wall surfaces forming two opposite narrow and broad side walls of the folding box and at least two side wall surfaces forming opposite head and bottom side walls.

A pull tab which according to an embodiment of the invention is detachably integrated in an external first side wall surface of the folding box blank alongside of the at least one or more tear line area(s) delimiting the same is particularly easily accessible.

Eventually, the folding box blank also is characterized in that it comprises the forming areas enabling the reclosability by being incised at head-side or bottom-side tabs of the folding box blank in such a way that they form insertion areas for closing areas of an associated head-side or bottom-side insertion tab co-operating therewith, or comprises an insertion slit enabling reclosability, which cooperates with an insertion tongue hinged to the pull tab.

Figure 2:
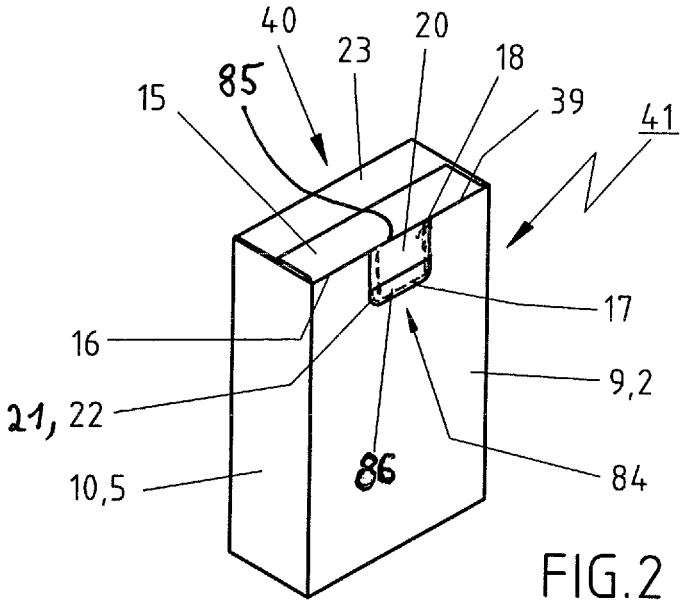
Figure 4:
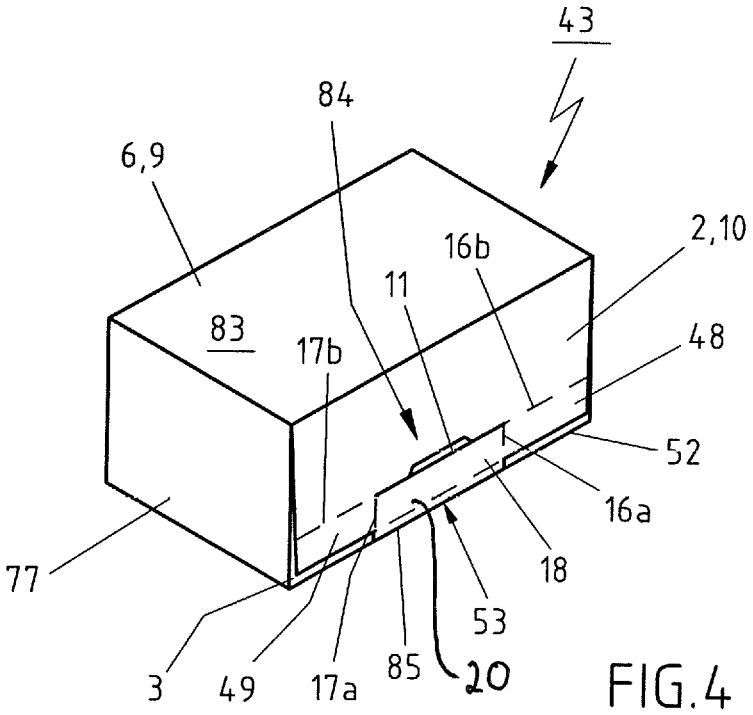
Figure 3:
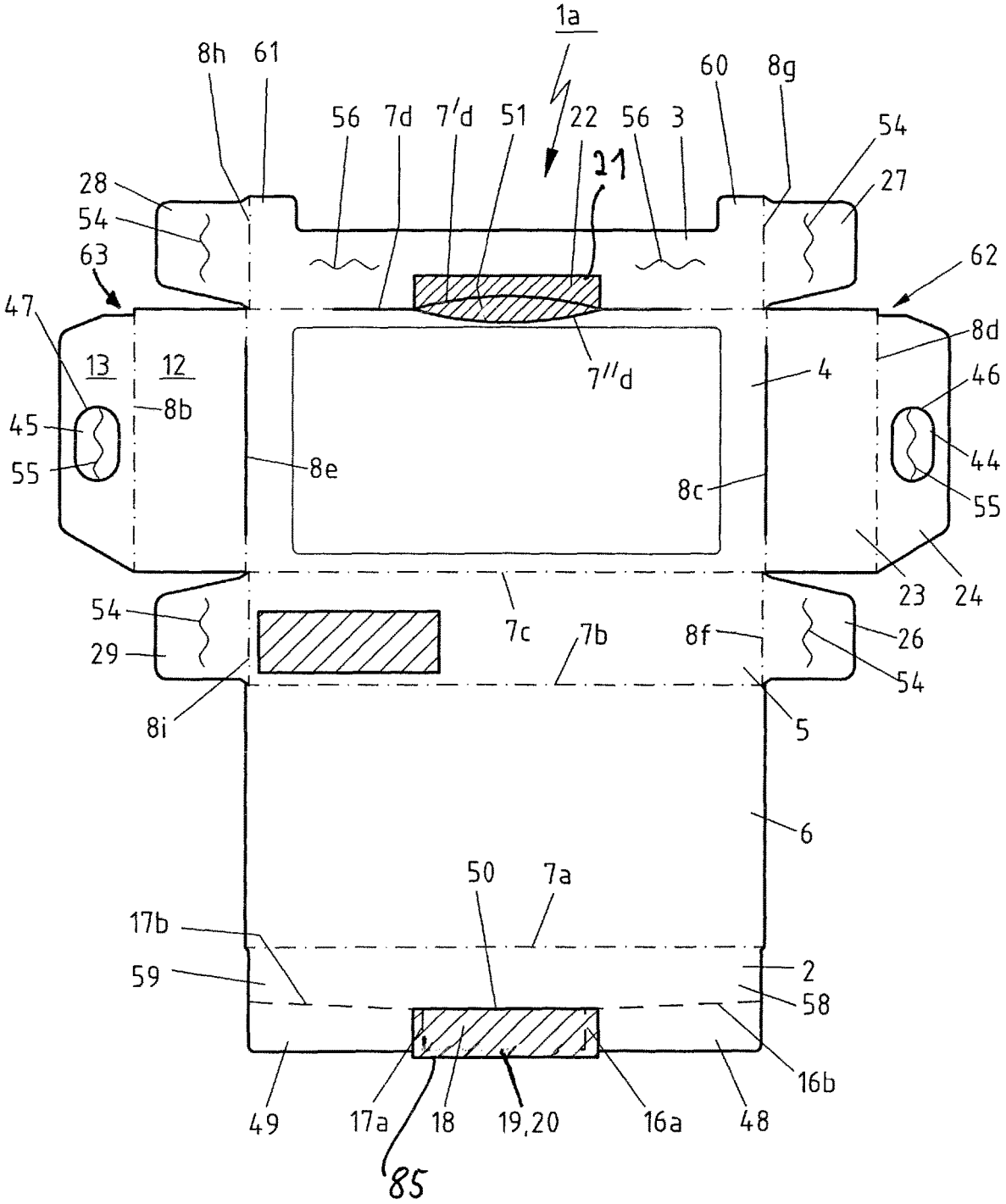
Figure 5:
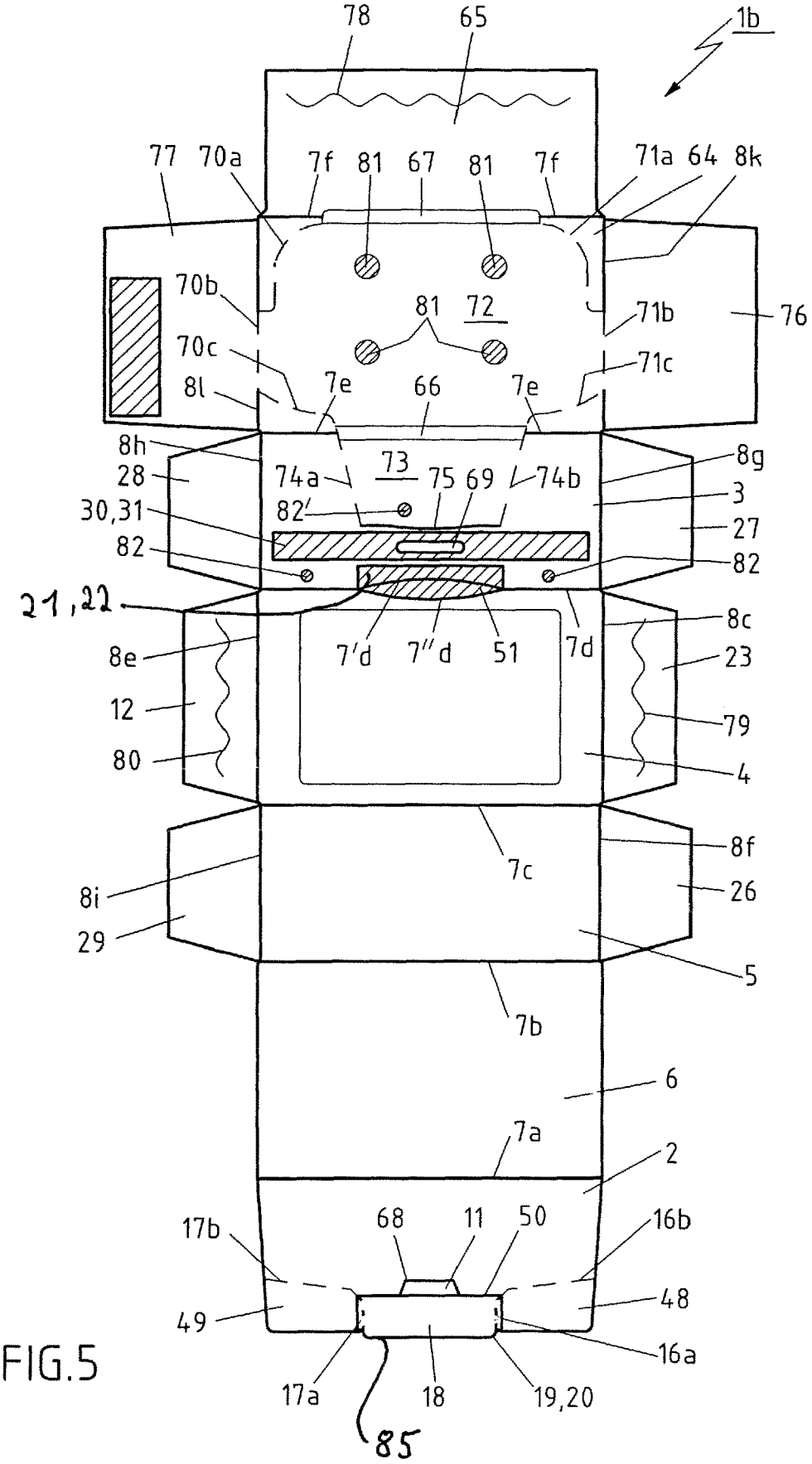
Figure 6:
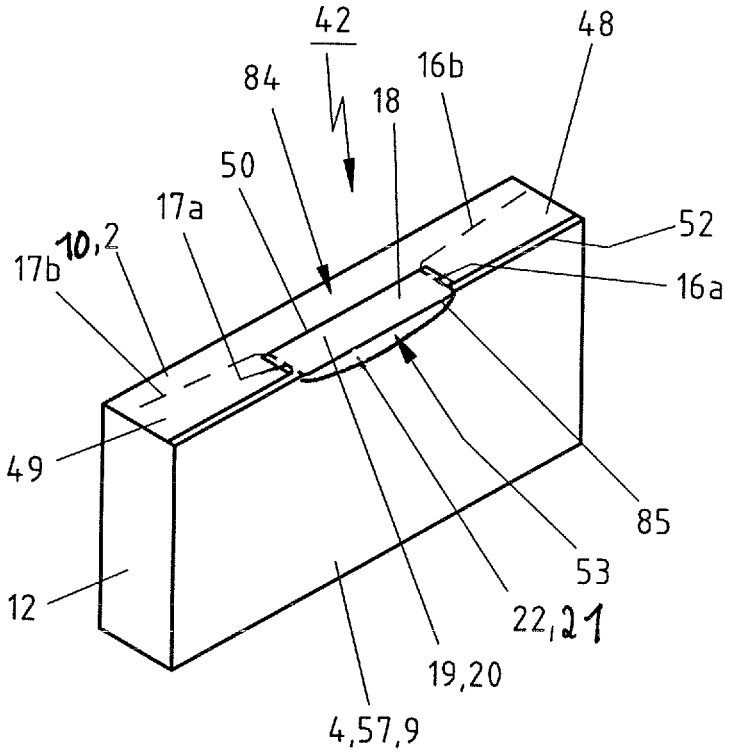

The description will now be described in more detail and by way of example using a drawing, in which:

FIG. 1 shows a top view of a first embodiment of a folding box blank according to the invention, FIG. 2 shows a schematic perspective view of a folding box produced from the folding box blank according to FIG. 1, FIG. 3 shows a top view of a second embodiment of a folding box blank according to the invention, FIG. 4 shows a schematic perspective view of a folding box produced from the folding box blank according to FIG. 5, FIG. 5 shows a top view of a third embodiment of a folding box blank according to the invention, and FIG. 6 shows a schematic perspective view of a folding box produced from the folding box blank according to FIG. 3.

FIG. 1 shows a top view of a folding box blank altogether referred to by 1, comprising a first side wall surface 2, a second side wall surface 3, a third side wall surface 4, a fourth side wall surface 5 and a fifth side wall surface 6. On their longitudinal sides, respectively two adjacent side wall surfaces from the group of the first side wall surface 2 to the fifth side wall surface 6 are respectively hinged to each other by a respective folding line 7*a* to 7*d*. In the erected folding box 41 (FIG. 2) formed by the altogether one-piece folding box blank 1, the first side wall surface 2 and the third side wall surface 4 respectively form one of two opposed broad side walls 9 of the folding box 41, and the second side wall surface 3 and the fourth side wall surface 5 form respectively opposed narrow side walls 10 of the folding box 41. The fifth side wall surface 6 forms a glued tab which, in order to produce the folding box 41, is provided with glue 32 on the side illustrated in FIG. 1, and on which the back of the second side wall surface 3 is glued in order to form a hose-like blank 1 when producing the folding box 41.

On its opposed transverse or broad sides, a first bottom side wall surface 12 is hinged by a folding line 8*a* on one side on the first side wall surface 2. A first insertion tab 13 is hinged to the first bottom side wall surface 12 by another folding line 8*b*. In its end regions, the folding line 8*b* is provided with opposite, respectively identical incisions 14*a*, 14*b*. Opposite the first bottom side wall surface 12, a first head side wall surface 15 is hinged to the broad side of the first side wall surface 2 alongside of a first perforation line 16. By means of a second perforation line 17, which originates from the first perforation line 16 and is formed in the first side wall surface 2, a pull tab 18 bounded by the first and second perforation lines 16, 17 is formed in a defined manner. An area or region 19 having a linear pattern 20, especially a guilloche pattern, is printed onto the outer surface of the pull tab 18 in a way to cover the second perforation line 17 and thus also the pull tab 18 in partial areas. Adjacent to the area or region 19 which does not cover the pull tab 18 entirely, another area or another region 21 of the pull tab is printed in a way overcoating the remaining areas of the second perforation line 17 in a contrast color 22 contrarian to the linear pattern 20. Preferably, said contrast color 22 is a signal color.

Thus, the pull tab 18 is limited by the second perforation line 17 and the first perforation line 16 which in the erected and glued state of the folding box 41 forms a head-side folding box edge 39, the boundary formed by the first perforation line 16 simultaneously forming an edge-side boundary line 85 of the pull tab 18. The second perforation line 17 forms the tear line area, beyond which the printed pattern 20 extends with at least one pattern line.

In an analogical position, which is, however arranged on the side opposite the first side wall surface 2 with respect to the arrangement, the third side wall surface 4 is provided with a now second head side wall surface 23 hinged alongside of its one transverse or broad side by a folding line 8*c*. A second insertion tab 24 is hinged to the second head side wall surface 23 by a folding line 8*d*. The folding line 8*d* is also provided in the form of incisions 14*c*, 14*d* in its opposed outer end regions, which are formed to be identical with the incisions 14*a*, 14*b* between the first bottom side wall surface 12 and the first insertion tab 13.

Opposite the second head side wall surface 23, a second bottom side wall surface 25 is hinged to the third side wall surface 4 by another folding line 8*e*.

On the second side wall surface 3 and the fourth side wall surface 5, a third head side wall surface 26 is hinged to the fourth side wall surface 5 and a fourth head side wall surface 27 is hinged to the second side wall surface 3 respectively on one side and by a respective folding line 8*f*, 8*g*. Opposite these, a third bottom side wall surface 28 is hinged to the second side wall surface 3 and a fourth bottom side wall surface 29 is hinged to the fourth side wall surface 5 by a respective folding line 8*h*, 8*i*.

A second linear pattern 31 is printed on the second insertion tab 24 in a region 30 associated with the pull tab 18 in the erected and produced folding box 8, which is formed in a manner to differ from the first linear pattern 20 in color and contrast.

In order to produce the folding box 41, the folding box blank 1, i.e. a hose-like folding box blank is produced by bonding the fifth side wall surface 6 forming a glued tab with the inner side of the second side wall surface 3. Then, the hose-like and bonded folding box blank 1 is erected to a cuboid shape, and the third and fourth bottom side wall surfaces 28, 20 are folded perpendicularly inwards. Then, the first bottom side wall surface 12 is folded in front of the third and fourth bottom side wall surfaces 28, 29, and the first insertion tab 13 is inserted under the inner side surface of the third side wall surface 4 beyond the third and fourth bottom side wall surfaces 28, 29. In this position, the first bottom side wall surface 12 and the second bottom side wall surface 25 are then glued together by means of a glue trail 33 applied to the outer surface of the first bottom side wall surface 12.

In order that the first insertion tab 13 can be easily folded inwards and in order that enough space is created for the first insertion tab 13 between the associated edge of the third and fourth bottom side wall surfaces 28, 29 on the one hand and the interior surface of the third side wall surface 4 on the other hand, while, on the other hand, sufficient friction and clamping action is exerted thereon, the edge areas of the third and fourth bottom side wall surfaces 28, 29 cooperating with the first insertion tab 13 are provided with stepped incisions 35, 36. In order to facilitate the insertion of the first insertion tab 13 in the region of these stepped cuts 35, 36, the edge areas of the first insertion tab 13 are formed in a rounded way. The elements now lying one upon the other, namely the third and fourth bottom side wall surfaces 28, 29 (on the interior side), the first bottom side wall surface 12 (intermediate position) and the second bottom side wall surface 25 disposed on the outside altogether form the bottom side wall of the folding box 41.

On its head side opposite the bottom side wall, the folding box 41 which is still open can now be filled with medical products. Subsequently, the third and fourth head side wall surfaces 26, 27 are folded perpendicularly inwards, the second head side wall surface 23 is laid in front of the folded third and fourth head side wall surfaces, and the second insertion tab 24 is pushed beyond the third and fourth head side wall surfaces 26, 27 under the first side wall surface 2. Then, the first head side wall surface 15 is folded in front of the second head side wall surface 23 and is glued thereto by means of a glue trail 34 applied to the outer side of the second head side wall surface 23.

In order to provide, analogously to the bottom side wall, corresponding insertion and attachment areas for the second insertion tab 24 also on the head side wall of the folding box 41, which later provides the reclosing function when the folding box 41 is reclosed, the edge areas of the third and fourth head side wall surfaces 26 27 cooperating with the second insertion tab 24 are also respectively provided with a stepped incision 37, 38.

In case of a closed folding box 41, its head side wall 40 is then formed by the internal third and fourth head side wall surfaces 26, 27, the second head side wall surface 23 as an intermediate layer, lying in front of the same, and the first head side wall surface 15 on the outer side.

The folding box 41 formed by the folding box blank 1 constitutes a folding box 41 which can be charged laterally and which can be opened laterally. The folding box 41 is closed completely and safely due to the one-piece blank 1 and the bonding on three side walls. If an adhesion is ripped open, this can be recognized as a manipulation on the folding box 41. The un-glued pull tab 18 is provided for opening the folding box 41. It constitutes the safety and tamper-evident closure 84 of the folding box 41. It is pushed-in in the partial area of the second perforation line 17 extending in the contrast colored region 21, 22, thereby releasing the perforation connection, whereupon the pull tab 18 can be put into an opening motion on an edge-side limiting edge 86 together with the first head side wall surface 15 using the thumb of one hand, which opening motion then also rips the first perforation line 16, and can then be moved until reaching the opening position of the folding box 41. During this movement, the second head side wall surface 23 is also moved into the opening position exposing a removal opening of the folding box 41 with the hinged second insertion tab 24 due to the adhesive bond between the first head side wall surface 15 and the second head side wall surface 23. The medical packaging product can then be removed and the folding box 41 can then be reclosed by inserting the third insertion tab 24 into the forming areas formed by the stepped incisions 37, 38. These closure areas thus form insertion areas for the arcuate side edge and closing areas of the first or head-side insertion tab 24, co-operating therewith. When opening or in order to open the folding box 41, the pull tab 18 may also be removed entirely. Such manipulation can be recognized in the reclosed folding box due to the fact that the second linear pattern 31 then becomes visible in the viewing window created after removing the pull tab 18.

Using the folding box blank 1*a* shown in FIG. 3, a folding box 42 can be produced which can be charged and opened on the top, as it is shown in FIG. 6. Therefore, in the folding box blank 1*a*, the third side wall surface 4 and the fifth side wall surface 6 form the broad side walls 9 of the folding box 42 and the first side wall surface 2, the second side wall surface 3 and the fourth side wall surface 5 form the narrow side walls 10 of the folding box 42, wherein the first side wall surface 2 and the second side wall surface 3 form the one narrow side wall 10, lying one upon the other. In this case, too, two adjacent side wall surfaces from the group of first to fifth side wall surfaces 2 to 6 are respectively hinged by means of a folding line 7*a* to 7*d* on a common longitudinal side. Third and fourth head side wall surfaces 26, 27 are hinged to the transverse or broad sides by folding lines 8*f*, 8*g*, and third and fourth bottom side wall surfaces 28, 29 are hinged by folding lines 8*h*, 8*i* on the second side wall surface 3 and fourth side wall surface 5 forming the narrow side wall 10 of the folding box 42. The third side wall surface 4 comprises on its transverse or broad sides a (second) head side wall surface 23 with a second insertion tab 24 hinged by a folding line 8*d*, wherein the (second) head side wall surface 23 is hinged to a third side wall surface 4 by a folding line 8*c*. Opposite thereto, a (first) bottom side wall surface 12 is hinged to the opposite broad side of the third side wall surface 4 by another folding line 8*e*, which in turn is connected to a first insertion tab 13 on its side opposite thereto by a folding line 8*b*. On the first insertion tab 13 and on the second insertion tab 24, an oval adhesive area 44, 45 is formed respectively centrally by means of a carving 46, 47 defining this respective area. In this respect, the carving 46, 47 passes only through half of the cardboard thickness of the folding box blank 1*a*, so that, in the later-described case of opening the folding box 42, the oval bonding areas 44, 45 are released from the respective side wall surface of the first and second insertion tabs 13, 24. In this embodiment, the pull tab 18 is formed in the first side wall surface 2 at the outer region thereof, and by means of a first perforation line 16 comprising a first partial area 16*a* delimiting the pull tab 18 against a glued tab area 48, and a partial area 16*b* by which the glued tab 48 is detachably limited against the adjoining area of the side wall surface 2. Analogously, a glued tab 49 is formed on the opposite side in the first side wall surface 2, which is limited by a second perforation line 17 in a first partial area 17*a* opposite the pull tab 18 and in a partial area 17*b* opposite the remaining area of the first side wall surface 2 in a detachable way. Between the partial areas or partial sections 16*b* and 17*b* of the first and second perforation lines 16, 17, the pull tab 18 is tied to the first side wall surface 2 by a folding line 50. The pull tab 18 is in turn provided with an area or a surface 19 which is printed with a first linear pattern 20, the linear pattern 20 extending with at least one pattern line via the sections or regions 16*a*, 17*b* of the first and second perforation lines 16, 17 laterally limiting the pull tab 18 into the area of the respectively abutting glued tab 48, 49.

A contrast color area 22 printed in contrast colors with respect to the linear pattern 20 and the external color of the usually light-colored folding box blank 1*a* is imprinted centrally in the second side wall surface 3, passing over the folding line 7*d* and reaching into the third side wall surface 4 in a position analogous to the pull tab 18. This contrast color area 22 graduates in an area 51 of the folding line 7*d* forming a bottom-side folding box edge 52 from the second side wall surface 3 into the third side wall surface 4, in which the folding line 7*d* splits into two folding line courses 7'*d* and 7"*d* and re-unites to the folding line 7*d*, so that the area 51 is formed in the shape of a pointed oval. In the established folding box 42 produced from the folding box blank 1*a*, this area of the pointed oval 51 is then formed in a trough-like manner in the folding box edge 52 in the manner of a grip recess 53 for inserting the thumb of one hand.

In order to produce the folding box 42, the second side wall surface 3 and the fourth side wall surface 5 are erected perpendicularly, and the third and fourth head side wall surfaces 26, 27 and the third and fourth bottom side wall surfaces 28, 29 are folded perpendicularly inwards. The respectively associated bottom side wall surface 12 and bottom side wall surface 23, respectively, are then laid against the bottom and head side wall surfaces 26 to 29 respectively provided with a glue trail 54 on their outer side, and glued together. In this respect, the insertion tabs 13 and 24 are folded alongside of their respective folding line 8*b*, 8*d* into a position parallel to the third side wall surface 4 and directed inwards. The folding box 42 which is then formed, and which is open on its upper side in a bowl-like manner, can then be filled, before the bonding areas 44, 45 are respectively provided with a glue trail 55, and the outer side of the second side wall surface 3 is provided with a glue trail 56 in the area respectively abutting against the glued tabs 48, 49, and are glued together by folding the third side wall surface 4 forming the upper side of the folding box 42 with the bonding areas 44, 45, and the glued tabs 48, 49 of the first side wall surface 2 are glued together by folding the first side wall surface 2 and applying onto the glue trails 56 with the second side wall surface 3. The third side wall surface 4 then forms a broad side wall 9 and the bottom side wall 57 of the folding box 42.

In order to open the folding box 42, a user may reach into the trough-shaped grasping area 53 with the thumb of one hand and may grasp the pull tab 18 in this area. If an appropriate amount of force is used, the pull tab 18 can be lifted and can be separated from the glued tabs 48, 49 together with the adjoining area of the first side wall surface 2 alongside of the first and second perforation lines 16 and 17. If the head (side) wall of the folding box 42 formed by the fifth side wall surface 6 is further flapped open, the bonding areas 44, 45 are ripped open along the carvings 46, 47 surrounding them, so that subsequently a folding box 42 opened on its top side is the result upon complete opening. In order to reclose this folding box 42, the corner areas 58, 59 remaining after tearing the glued tabs 48, 49 are slipped-in on the inner side of the folding box behind corresponding corner areas 60, 61 of the second side wall surface 3. In order to make this possible easily and with a friction force sufficient to secure the closure position, the first insertion tab 13 and the second insertion tab 24 are respectively provided with a correspondingly formed stepped incision 62, 63, wherein also the edge areas of the respectively adjoining fourth head side wall surface or tab 26 and third bottom side wall surface or tab 28 are provided with corresponding incisions on their longitudinal edge facing this insertion side. This reclosing insertion process involves the pull tab 18 being inserted in the folding box 42 with its printed area 19, so that the printed area 19 rests against the second side wall surface 3 on the inner side.

The folding box 43 (FIG. 4) formed by the blank 1*b* (FIG. 5) is formed in a way similar to the folding box 42 (FIG. 6); it is, however, formed as a folding box 43 to be charged laterally and opened laterally, another substantial difference being that the side wall areas of the folding box 43 are formed in several layers.

Just as it is the case with the folding box blanks 1 and 1*a*, the one-piece folding box blank 1*b* (third embodiment) first comprises the group of the first to fifth side wall surfaces 2 to 6. In addition, it also comprises a sixth side wall surface 64 and a seventh side wall surface 65. In this case as well, respectively two adjacent side wall surfaces are connected by means of one of the folding lines 7*a* to 7*d* on their abutting longitudinal sides. Similarly, two further folding lines 7*e* and 7*f* are provided in addition to the articulation of the sixth and seventh side wall surfaces 64, 65. In this respect, the folding lines 7*e* and 7*f* are interrupted by punched-out areas 66, 67 in their central area.

The first side wall surface 2 is formed analogously to and in the same way as the first side wall surface 2 in the second embodiment according to FIG. 3. It comprises the pull tab 18 which in turn is delimited on one side by a first part 16*a* of a first perforation line 16 with respect to a glued tab 48 formed in the first side wall surface 2. In its further course 16*b*, the first perforation line 16 delimits the glued tab 48 against the abutting area of the first side wall surface 2. Analogously, a second perforation line 17 is formed on the opposite side, which delimits a glued tab 49 alongside of its perforation line portion 17*a* against the pull tab 18 and alongside of its perforation line portion 17*b* against the remaining area of the first side wall surface 2. Between the partial areas 16*b* and 17*b* of the first and second perforation lines 16, 17, the pull tab 18 is in turn articulated alongside of a folding line 50 to the first side wall surface 2. Starting from this folding line 50, the pull tab 18 comprises an insertion tongue 11 in this third exemplary embodiment of a folding box blank 1*b* according to FIG. 5, which is delimited alongside of a punching line 68 in the surface of the first side wall surface 2, protruding into the first side wall surface 2. This insertion tongue 11 cooperates with an insertion slit 69 formed in the second side wall surface 3, into which the insertion tongue 11 is inserted for reclosing the folding box 43, when the folding box 43 (FIG. 4) formed by the folding box blank 1*b* is reclosed at a later stage.

The fifth side wall surface 6, the fourth side wall surface 5, the third side wall surface 4 and the second side wall surface 3, formed in the one-piece blank 1*b*, are, analogously to the embodiment according to FIG. 3, provided with lateral taps or flaps, namely a first bottom side wall surface 12 and a second head side wall surface 23 (third side wall surface 4, a third head side wall surface 26 and a fourth bottom side wall surface 29 (fourth side wall surface 5), as well as a fourth head side wall surface 27 and a third bottom side wall surface 28 (second side wall surface 3), which are respectively hinged to the respective second to fourth side wall surfaces 3 to 6 by one of the folding lines 8*c*, 8*e*, 8*f*, 8*g*, 8*h*, 8*i*. Since a folding box 43 which can be charged laterally and opened laterally can be produced using the folding box blank 1*b*, the side wall surfaces 26 to 29, 12 and 23 are then pure side wall surfaces which in the application position of the folding box 43 form neither the head side or head surface, nor the bottom side or bottom surface of the folding box 43, even if their respective name may suggest something else. In order to simplify a comparability of the three embodiments of folding box blanks 1, 1*a* and 1*b*, as well as of the three folding boxes 41, 42 and 43, a consistent denomination has been maintained for analogous tabs, flaps and side surfaces, even if the corresponding side surface does for example not form the head side surface or the bottom side surface in the application position of the respective folding box 41, 42, or 43.

The pull tab 18 according to the exemplary embodiment according to FIG. 5 is, again in its area 19, printed with a first linear pattern 20 which with at least one pattern line extends beyond the abutting sections 16*a* and 17*a* of first and second perforation lines 16, 17.

Analogously to the embodiment according to FIG. 3, the folding line 7*d* connecting the second side wall surface 3 of the folding box blank 1*b* according to FIG. 5 to the third side wall surface 4 is in its central area corresponding to the position of the pull tab 18 formed by two partial sections 7'*d* and 7"*d* which first split and then re-unite into the one folding line 7*d*, and which enclose a surface formed as a pointed oval 51 between one another. Here, the folding line section 7'*d* is again formed in the external-side surface of the second side wall surface 3, and the folding line section 7"*d* is formed in the external-side surface of the third side wall surface 4. In addition, this area is again provided with the printed area 22, which is printed with a color, preferably a signal color, rich in contrast compared to the first linear pattern 20, and which graduates from the second side wall surface 3 into the abutting area of the third side wall surface 4. An area 30 joins on the outer side of the second side wall surface 3, which is printed with a second linear pattern 31, which is formed to be different in color and/or in contrast and/or linearly with respect to the first linear pattern 20, wherein the second linear pattern 31 is also imprinted. Preferably, both the first linear pattern 20 and the second linear pattern 31 are a guilloche pattern. The insertion slit 69 is formed as a punched-out surface in the area 30 and thus in the surface of the second linear pattern 31.

Since the reclosability in the folding box 43 formed by the folding box blank 1*b* is ensured by inserting the insertion tongue 11 into the insertion slit 69, other insertion tabs causing a re-closure are not necessary. The side wall surfaces 12, 23, 26 to 29 are therefore formed without forming corresponding insertion tabs, and do not comprise any stepped incisions cooperating with an insertion tab of this type.

In order to form the folding box 43 in several layers on different side walls, the blank 1*b* additionally comprises the sixth side wall surface 64 and the seventh side wall surface 65. A detachable side wall surface area 72 is formed in the sixth side wall surface 64 by means of perforation lines 70*a* to 70*c* and 71*a* to 71*c*. Another side wall surface area 73 is formed in the second side wall surface 3 and is delimited in a way to be detachable therefrom by means of perforation lines 74*a*, 74*b* and a punching line 75 in the second side wall surface 3. Fifth and sixth bottom or head side surfaces 76, 77 are hinged by folding lines 8*k* and 8*l* on opposite sides of the sixth side wall surface 64.

In order to build the folding box 43, the third side wall surface 4 is taken as a bottom surface and the fourth side wall surface 5 hinged thereto and the fifth side wall surface 6 hinged thereto are folded with their internal side onto the outer side of the seventh side wall surface 65 and the sixth side wall surface 64, such that the fourth side wall surface 5 is glued with a glue trail 78 applied to the seventh side wall surface 65 and the internal side of the fifth side wall surface 6 is glued with glue dots 81 formed in the side wall surface area 72 of the outer surface of the sixth side wall surface 64. Subsequently, the internal side of the first side wall surface 2 is folded onto the outer side of the second side wall surface 3 and is glued with glue dots 82, 82' formed thereon. Here, the glue dot 82' is formed in the side wall surface area 73 of the second side wall surface 3, and the glue dots 82 are formed in areas which then come to lie against the glued tabs 48, 49. The folding box blank 1*b* thereby formed in a hose-like manner is then erected. The side wall surfaces 26, 27, 28 and 29 are then put into an approximately perpendicular position, and the second head side surface 23 and the first bottom side surface 12 come to abut in front of the same. In order to complete these side surfaces, the side surfaces 76 and 77 are then folded onto the side surfaces of first bottom side wall surface 12 and second head side wall surface 23, respectively comprising a glue trail 79, 80, and are glued therewith. Prior to that, the folding box 43 to be opened laterally and to be filled laterally is filled with a medical product. The folding box 43 comprises a double-layered folding box upper side 83, which is formed by the fifth and sixth side wall surfaces 6, 64. Similarly, the second and first side wall surfaces 2, 3 form a double-layered narrow side wall 10 or front wall of the folding box 43. In the closed, glued and erected folding box, a trough-shaped "indentation" 53 is formed in the area of the pointed oval 51 in the area of the bottom-side folding box edge 52, which permits and facilitates the grasping of the longitudinal edge or edge-side boundary line 85 of the pull tab 18 arranged in this area. In order to open the folding box 43, the pull tab 18 is grasped from the side of the trough-shaped depression 53, and the first side wall surface 2 is moved into its opening position by corresponding tearing, thereby separating the perforation lines 16*a*, 16*b* and 17*a*, 17*b*. In this respect, the glue dots 82 cause the adhesive tabs 48, 49 to remain in their position, and the glue dot 82 causes the side wall surface area 73 of the second side wall surface to be taken along upon pivoting the first side wall surface open and to be detached alongside of the perforation lines 74*a* and 74*b* and the punching line 75 from the side surface of the second side wall surface 3. In order to then open the folding box 43 on the upper side, the fifth side wall surface 6 forming the folding box upper side 83 is now swiveled out as well. In this respect, the glue dots 81 cause the side wall surface area 72 to be moved along and to be detached from the side wall of the sixth side wall surface 64 alongside of the perforation lines 70*a*, 70*b*, 70*c*, 71*a*, 71*b* and 71*c*. The medical product contained in the folding box 43 can now be removed from the folding box 43, which is opened on the top. In order to reclose the folding box, the fifth side wall surface 6 and the first side wall surface 2 are folded back into their closed position. In order to hold the folding box 43 in its reclosed position, the insertion tongue 11 is inserted into the insertion slit 69. In this insertion position, an incision is then formed in the area first forming the insertion tongue 11 in the first side wall surface 2, through which the second linear pattern 31 printed onto the upper side of the second side wall surface 3 is visible in this area. This is a further hint for the user, indicating that this reclosed folding box 43 has already been opened.

Even if reference has concretely been made to perforation lines or punching lines in the above description, they form specific embodiments of the elements generally referred to as tear lines or tear line areas within the context of this application.

In addition, equal or analogous elements or elements having the same effect have been provided with the same reference numbers in all exemplary embodiments in the above description.

The blanks 1, 1*a*, 1*b* are made of a conventional packaging board, so that all above-mentioned side wall surfaces of the blanks 1, 1*a*, 1*b* form elements of the folding box side walls respectively made of cardboard.

The invention claimed is:

1. A folding box blank configured to form a reclosable folding box having a safety and tamper-evident closure; wherein the folding box blank is a one-piece blank comprising:

a pull tab;

a plurality of side wall surfaces;

wherein the pull tab and the plurality of side wall surfaces are glued to form the reclosable folding box that cannot be opened without destroying a glued joint, at least one disconnectable tear line area, or a combination of a glued joint and at least one disconnectable tear line area;

wherein the pull tab is arranged on a folding box outer side upper side; wherein the pull tab comprises a first linear pattern;

wherein a second linear pattern is formed on a side wall surface facing the folding box outer side in an area covered by the pull tab resting against the pull tab if the folding box is erected; and wherein the second linear pattern differs from the first linear pattern; and a gripping recess at least partially adjacent to the first linear pattern where the gripping recess is at least partially visible from the folding box outer side when the folding box is erected from the folding box blank; wherein the gripping recess comprises a contrast color, a contrast pattern, or combinations thereof with respect to the first linear pattern and the second linear pattern;

wherein at least a portion of the folding box blank comprises a different color, a different pattern, or combinations thereof with respect to the first linear pattern, the second linear pattern, and the gripping recess; wherein the at least a portion of the folding box blank is directly adjacent to the first linear pattern, the second linear pattern, and the gripping recess.

2. The folding box blank according to claim 1, wherein the at least one disconnectable tear line area is formed as a linear carving or as a perforation line.

3. The folding box blank according to claim 1, wherein the plurality of side wall surfaces comprises at least four side wall surfaces forming respectively two opposite narrow and broad side walls of the folding box and at least two side wall surfaces forming opposite head and bottom side walls.

4. The folding box blank according to claim 1, wherein the pull tab is detachably integrated into the first side wall surface of the folding box blank alongside the at least one disconnectable tear line area delimiting the same.

5. The folding box blank according to claim 1, wherein the reclosable folding box blank comprises an insertion slit enabling reclosability, wherein the insertion slit cooperates with an insertion tongue hinged to the pull tab.

6. The folding box blank of claim 1, wherein the at least a portion of the folding box blank is the remainder of the folding box blank.

* * * * *